US009471013B2

(12) United States Patent
Asano

(10) Patent No.: US 9,471,013 B2
(45) Date of Patent: Oct. 18, 2016

(54) IMAGE FORMING APPARATUS HAVING HEAT GENERATING MEMBER INTO WHICH AN ALTERNATING-CURRENT WAVEFORM CORRESPONDING TO THE SUPPLIED POWER FLOWS

(71) Applicant: CANON KABUSHIKI KAISHA, Tokyo (JP)

(72) Inventor: Hiroki Asano, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/702,877

(22) Filed: May 4, 2015

(65) Prior Publication Data

US 2015/0331368 A1 Nov. 19, 2015

(30) Foreign Application Priority Data

May 16, 2014 (JP) ..... 2014-102660

(51) Int. Cl.
*G03G 15/20* (2006.01)
*G03G 15/00* (2006.01)

(52) U.S. Cl.
CPC ..... *G03G 15/2039* (2013.01); *G03G 15/5004* (2013.01); *G03G 15/80* (2013.01); *G03G 2215/2035* (2013.01)

(58) Field of Classification Search
CPC ..... G03G 15/80
See application file for complete search history.

(56) References Cited

U.S. PATENT DOCUMENTS 8,494,383 B2 7/2013 Shimura et al.
8,521,049 B2 * 8/2013 Chosokabe ..... G03G 15/2039 399/67
8,818,226 B2 8/2014 Asano
2009/0179626 A1 * 7/2009 Smith ..... G03G 15/5004 323/299

(Continued)

FOREIGN PATENT DOCUMENTS

EP 2261754 A1 12/2010
EP 2363759 A1 9/2011

(Continued)

OTHER PUBLICATIONS

"Agilent AN 1273, Compliance Testing to the IEC 1000-3-2 (EN 6100-3-2) and IEC 1000-3-3 (EN 6100-3-3) Standards," Agilent Technologies, 2000. pp. 1-56.

(Continued)

*Primary Examiner* — Minh Phan
*Assistant Examiner* — Victor Verbitsky
(74) *Attorney, Agent, or Firm* — Fitzpatrick, Cella, Harper & Scinto

(57) ABSTRACT

Depending on an output impedance of a commercial AC power supply calculated by an output impedance calculating unit, a control unit controls the supply of power so that the current of a first waveform pattern, capable of supplying an amount of power to be supplied to a heat generating member determined based on temperature information and capable of supplying power such that a harmonic current value is suppressed to be smaller than a predetermined value, flows into the heat generating member, or the control unit controls the supply of power so that the current of a second waveform pattern, capable of supplying an amount of power to be supplied to the heat generating member based on the temperature information and capable of supplying power such that the value of a flicker Pst is suppressed to be smaller than a predetermined value, flows into the heat generating member.

6 Claims, 12 Drawing Sheets

(56) References Cited

U.S. PATENT DOCUMENTS

| | | | | |
|---|---|---|---|---|
| 2009/0304421 | A1 | 12/2009 | Saito et al. | |
| 2010/0310267 | A1 | 12/2010 | Shimura et al. | |
| 2010/0316404 | A1* | 12/2010 | Fukuzawa | G03G 15/2039 399/69 |
| 2011/0217062 | A1 | 9/2011 | Chosokabe et al. | |
| 2011/0274456 | A1 | 11/2011 | Higashi et al. | |
| 2013/0266334 | A1 | 10/2013 | Shimura et al. | |
| 2014/0293358 | A1* | 10/2014 | Inukai | H04N 1/00888 358/300 |

FOREIGN PATENT DOCUMENTS

| | | | |
|---|---|---|---|
| JP | 2006-268680 | A | 10/2006 |
| JP | 2008-040072 | | 2/2008 |
| JP | 2013-037084 | A | 2/2013 |

OTHER PUBLICATIONS

European Search Report issued in counterpart European Patent Application No. 15165326.8-1560, dated Oct. 2, 2015.

* cited by examiner

FIG.8

| POWER LEVEL | ENERGIZATION TABLE REF | ENERGIZATION TABLE A | ENERGIZATION TABLE B |
|---|---|---|---|
| LEVEL0 | | | |
| LEVEL1 | | | |
| LEVEL2 | | | |
| LEVEL3 | | | |
| LEVEL4 | | | |
| LEVEL5 | | | |
| LEVEL6 | | | |
| LEVEL7 | | | |
| LEVEL8 | | | |
| LEVEL9 | | | |
| LEVEL10 | | | |
| LEVEL11 | | | |
| LEVEL12 | | | |
| LEVEL13 | | | |
| LEVEL14 | | | |

IMAGE FORMING APPARATUS HAVING HEAT GENERATING MEMBER INTO WHICH AN ALTERNATING-CURRENT WAVEFORM CORRESPONDING TO THE SUPPLIED POWER FLOWS

BACKGROUND OF THE INVENTION

1. Field of the Invention

The present invention relates to an image forming apparatus which uses an electrophotographic system.

2. Description of the Related Art

In an image forming apparatus such as a copier, a laser printer, or a facsimile, a film heating-type fixing apparatus,. which uses a ceramic heater as a heat source, is widely used as a fixing apparatus that heats and fixes a toner image formed on a recording sheet. The heater is connected to an AC power supply via a switching element such as a triac or a mechanical switch element such as a relay. In general, power is supplied to the heater by turning the switching element on and off so as to maintain the temperature detected by a temperature detection element disposed near the heater. The on/off control is performed based on a predetermined current waveform pattern. This waveform pattern is determined according to phase control that controls the energization ratio in a half-wave of an AC power supply, wave-number control that uses a predetermined number of successive half-waves of an AC power supply as one control cycle and controls the number of half-waves corresponding to an energization period in one control cycle, or a combination of the phase control and wave-number control. These control methods are determined by taking flicker and harmonic currents into consideration.

Here, flicker is a phenomenon in which a lighting equipment flicker due to the fluctuation of the voltage of an AC power supply under the influence of a load current fluctuation in an electric equipment connected to the same AC power supply as the lighting equipment and an output impedance of the AC power supply. A perceptibility short term (Pst: short-term flicker value), which is a statistically calculated index, is frequently used as a flicker level. International Electrotechnical Commission (IEC) defines a standard Pst value (see IEC 61000-3-3). The larger the voltage fluctuation, the larger (worse) the Pst. Moreover, the Pst is weighted according to the frequency and increases particularly when a voltage fluctuation occurs near 10 Hz, where human perceptibility is maximized. On the other hand, standard values for 2nd-order to 40th-order harmonic currents are defined using an AC power supply as a fundamental wave (see IEC 61000-3-2). The larger the degree of distortion from a sinusoidal wave, of a current waveform from the AC power supply, the more likely the harmonic current is to occur.

Thus, the phase control in which energization is performed for every wave is advantageous in suppressing flicker since a voltage fluctuation at such a low frequency as 10 Hz rarely occurs, but is disadvantageous in suppressing harmonic currents since the degree of distortion from a sinusoidal wave is large. On the other hand, wave-number control in which a current waveform pattern is repeated in one control cycle is disadvantageous in suppressing flicker since a low-frequency voltage fluctuation is likely to occur, but is advantageous in suppressing harmonic currents since energization is not performed in the middle of a half-wave. As above, although flicker and the harmonic current are generally in a trade-off relation with respect to the current waveform pattern, the current waveform pattern needs to be set so as to satisfy the flicker and harmonic current standards. In recent years, since image forming apparatuses have been operating at higher speed and requiring larger power, and the resistance value of the heater has been decreasing further, it has become difficult to set the current waveform pattern that satisfies both standards.

To cope with this, a method for satisfying the flicker and harmonic current standards by dividing the heater into a plurality of parts, connecting the parts in parallel, and forming a switching element in each part is proposed. That is, this method involves decreasing the harmonic current value by performing phase control so that energization of a plurality of heaters does not start at the same time-point and suppressing flicker by performing wave-number control so that the total voltage fluctuation in the plurality of heaters in one control cycle decreases. However, this method may increase the circuit size and incurs a large increase in the cost.

Moreover, a method of suppressing harmonic currents, by arranging an active filter and a high-frequency coil in an AC/DC power supply circuit unit that generates a voltage for a drive member, such as a motor, and a voltage for a control unit so that a current waveform from of the AC power supply approaches a sinusoidal wave, is often used. However, since the active filter circuit is complex and includes a large number of components and the high-frequency coil is large and heavy, any of the above-mentioned configurations results in a large increase in the cost.

Moreover, various control methods for changing the current waveform pattern according to an operating condition of an image forming apparatus are proposed. For example, a control method of determining a voltage area (100V area or 200V area) based on a voltage of an AC power supply in an image forming apparatus, which uses a universal AC/DC power supply, and selecting phase control or wave-number control based on the determination result, is proposed. That is, phase control that is advantageous in suppressing flicker is selected for the 100V area since the 100V area uses a large load current as compared to the 200V area and the voltage fluctuation of the AC power supply is large. On the other hand, wave-number control that is advantageous in suppressing harmonic currents is selected for the 200V area since the 200V area uses a higher AC power supply voltage as compared to the 100V area. Further, a control method of switching between phase control and wave-number control according to print conditions, such as a process speed or a control target temperature, is also proposed. Further, Japanese Patent Application Laid-Open No. 2008-40072 proposes a control method of detecting the intensity of illumination of the surroundings using an illuminometer and switching between phase control and wave-number control based on the detection result. The illuminometer detects flicker in the surroundings, and phase control is performed when the flicker is large, whereas wave-number control is performed when the flicker is small.

The output impedance of the AC power supply has correlation with the flicker Pst and the harmonic current. In general, the output impedance of an AC power supply includes the output impedance of a transformer on the electric pole, the line impedance of a lead-in wire extending from the transformer on the electric pole to an outlet via a distribution board, and the line impedance of a power supply cable extending from the outlet to an inlet portion of the image forming apparatus. The output impedance of the AC power supply is different depending on the output impedance of the transformer on the electric pole and the material, the thickness, the length, and the wiring method of the lead-in wire and the power supply cable.

FIG. 5 illustrates the relation among an output impedance, the flicker Pst, and the harmonic current. The horizontal axis represents the absolute value |Zout (50 Hz)| of an output impedance Zout at the frequency 50 Hz of an AC power supply and the vertical axis represents a flicker Pst and a harmonic current. In the graph, a solid line indicates the flicker Pst and the broken line indicates the harmonic current. From FIG. 5, it can be understood that the larger the output impedance of the AC power supply, the larger the flicker level becomes. This is because the voltage fluctuation increases due to the output impedance. Moreover, it can be understood that the smaller the output impedance of the AC power supply, the larger the harmonic current becomes. This is because the smaller the output impedance, the larger the harmonic current flowing from the AC power supply to the image forming apparatus.

The IEC standards define flicker Pst as being measured at an output impedance of 0.4+j0.25Ω and define harmonic current as being measured at an output impedance of approximately 0 (that is, an AC power supply having a sufficiently small output impedance is used and no additional impedance is inserted). As indicated by reference numerals 501 and 502 in FIG. 5, this means that both the flicker Pst and the harmonic current are measured in very unfavorable conditions. In other words, this means that the flicker Pst and harmonic current standards need to be satisfied for an AC power supply having a wide range of output impedances of 0 to 0.4+j0.25Ω.

In contrast, in the method of Japanese Patent Application Laid-Open No. 2008-40072, although power control based on the output impedance can be realized to some extent by switching the control based on the detected flicker, it is necessary to add the illuminometer, which results in a considerable increase in the cost and an increase in the arrangement space.

SUMMARY OF THE INVENTION

The present invention has been made in view of the above problems, and an object of the present invention is to provide an image forming apparatus capable of suppressing flicker and harmonic currents. Another object of the present invention is to provide an image forming apparatus capable of realizing power control that satisfies both flicker standards and harmonic current standards.

A further object of the present invention is to provide an image forming apparatus comprising:

an image forming unit that forms an unfixed toner image on a recording material;

a fixing unit that heats the unfixed toner image formed on the recording material and fixes the unfixed toner image to the recording material, the fixing unit having a heat generating member that generates heat with power supplied from a commercial AC power supply;

a control unit that controls the supply of the power to the heat generating member from the commercial AC power supply according to the temperature of the fixing unit, the control unit performing control so that an alternating-current waveform corresponding to the supplied power flows into the heat generating member; and an acquiring unit that acquires the output impedance of the commercial AC power supply, wherein the control unit is configured to select a first waveform table in which the alternating-current waveforms corresponding to the supplied powers are set and a second waveform table in which alternating-current waveforms different from the alternating-current waveforms set in the first waveform table are set, and the control unit selects the first waveform table or the second waveform table according to the output impedance acquired by the acquiring unit.

Further features of the present invention will become apparent from the following description of exemplary embodiments (with reference to the attached drawings).

BRIEF DESCRIPTION OF THE DRAWINGS

FIG. 8 is a diagram illustrating an energization table showing waveform patterns at respective power levels;

DESCRIPTION OF THE EMBODIMENTS

Hereinafter, a mode for carrying out this invention will be described in detail based on an illustrative embodiment with reference to the drawings. It should be noted that the dimensions, materials, shapes, relative arrangement, and other features of the components described in the embodiments are to be appropriately changed according to various conditions and the configuration of the apparatus to which the invention is applied. That is, the scope of the invention is not intended to be limited to the following embodiments.

(First Embodiment)

Figure 1:
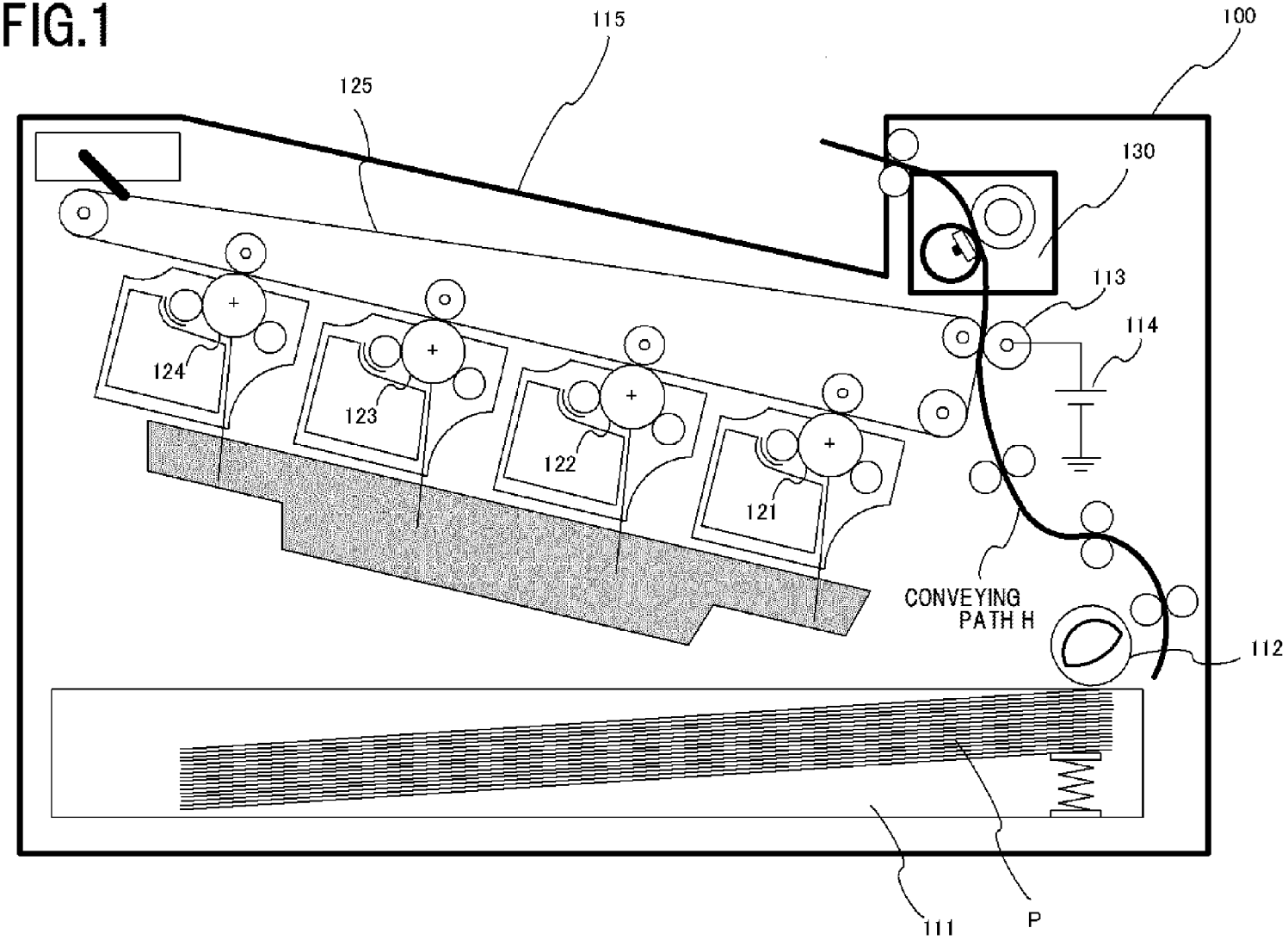
FIG. 1 is a schematic cross-sectional view of an image forming apparatus according to an embodiment of the present invention.

FIG. 1 is a schematic cross-sectional view illustrating an overall configuration of an image forming apparatus according to an embodiment of the present invention. An image forming apparatus 100 according to this embodiment is a full-color laser printer capable of forming a full-color image on a recording sheet (recording material) P according to an electrophotographic system. That is, the image forming apparatus 100 forms monochrome toner images of yellow (Y), magenta (M), cyan (C), and black (K) on photosensitive members 121, 122, 123, and 124 and superimposes these toner images on an intermediate transfer member 125 to thereby form a multi-color toner image on the intermediate transfer member 125. A recording sheet P which has been fed from a sheet feeder 111 by a feed roller 112 and conveyed along a conveying path H is sandwiched and pressed at an area between a transfer roller 113 and the multi-color toner image formed on the intermediate transfer member 125. As a result, since the transfer roller 113 is applied with a positive bias by a transfer bias generator 114, the multi-color toner image charged with a negative polarity is transferred to the recording sheet P. After that, the multi-color toner image on the recording sheet P is heated and fixed by a fixing apparatus (fixing unit) 130, and the recording sheet P is finally discharged to a discharge tray 115. In the above-described configuration, a configuration associated with forming of an unfixed toner image, which has not been fixed to the recording sheet P, corresponds to an image forming unit according to the present invention.

Figure 2:
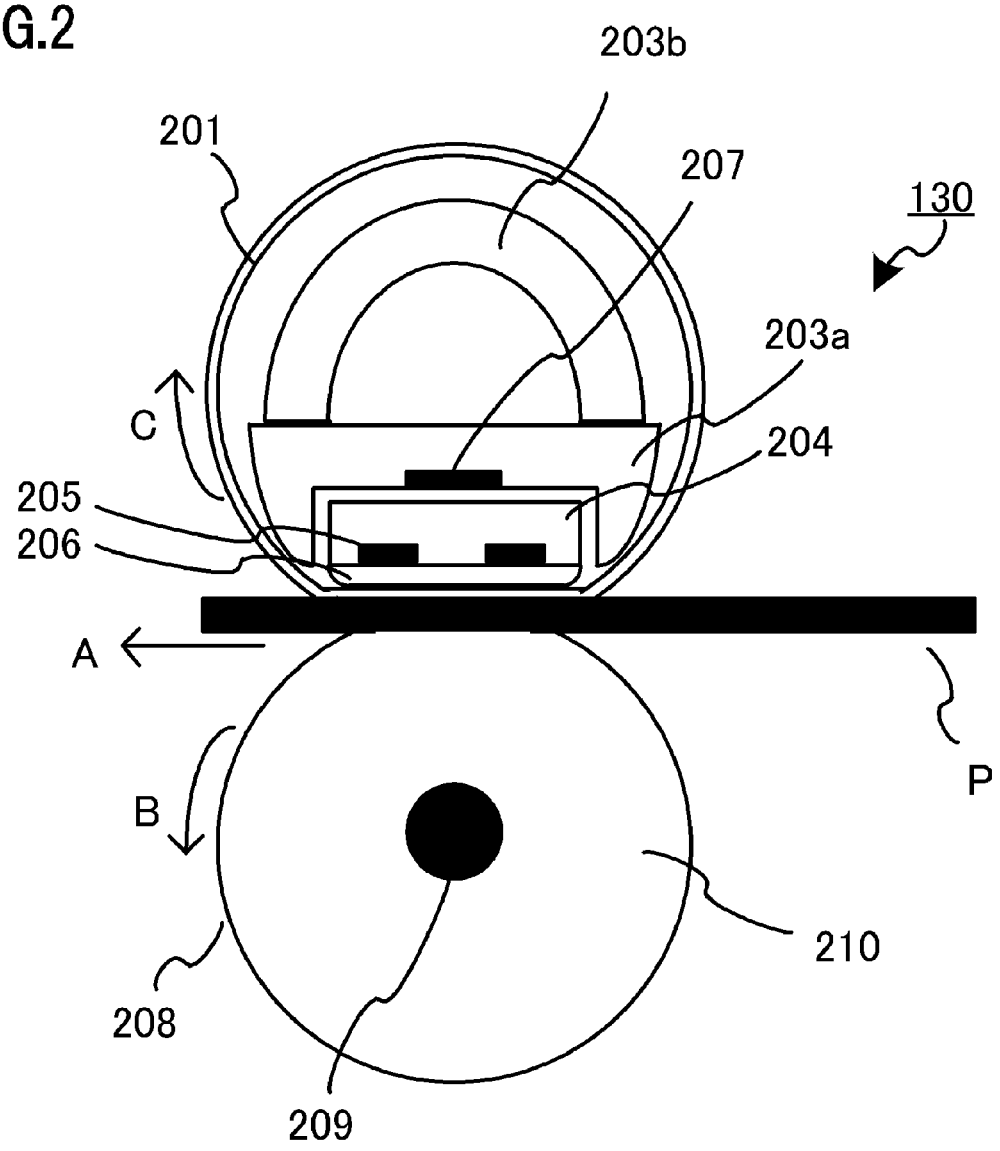
FIG. 2 is a diagram for illustrating a configuration of a fixing apparatus (fixing unit) according to an embodiment of the present invention.

FIG. 2 is a schematic cross-sectional view illustrating the overall configuration of the fixing apparatus according to an embodiment of the present invention. The fixing apparatus 130 includes a heater 204, a thermistor 207, a heater holder 203*a*, a stay 203*b*, a fixing film 201, and a pressure roller 208. The heater 204 is a ceramic heater and the thermistor 207 as a temperature detection element (temperature detecting unit) is disposed near the heater 204. The heater holder 203*a* is a heat-resistant adiabatic member for fixing and supporting the heater 204. The stay 203*b* is a metal member for reinforcing the heater holder 203*a*. The fixing film 201 is a cylindrical heat-resistant film material and covers the heater 204 and the stay 203. The pressure roller 208 has a configuration in which a heat-resistant elastic layer 210 formed of silicon rubber or the like is provided around a core or metal pipe 209 in a roller form.

A heat generating member pattern 205 is formed on the heater 204, which is covered with an electric insulating layer 206 formed of glass or the like. The pressure roller 208 and the heater 204 are in pressure contact with each other with the fixing film 201 interposed. The pressure roller 208 is rotated at a predetermined circumferential speed in the direction indicated by arrow B by a fixing driving motor (not illustrated). The rotational force of the pressure roller 208 directly acts on the fixing film 201 due to the frictional force between the pressure roller 208 and the outer surface of the fixing film 201. Thus, the fixing film 201 is rotated in the direction indicated by arrow C while sliding in pressure contact with the insulating layer 206. In this case, the heater holder 203*a* also functions as a member for guiding the inner surface of the fixing film 201 to facilitate the rotation of the fixing film 201. In a state in which the rotation of the fixing film 201 following the rotation of the pressure roller 208 is stabilized and the temperature of the heater 204 reaches a predetermined temperature (control target temperature), the recording sheet P to which the multi-color toner image is transferred is conveyed in the direction indicated by arrow A. The conveyed recording sheet P is pressurized by the pressure roller 208 together with the fixing film 201, whereby the heat of the heater 204 is applied to the recording sheet P via the fixing film 201 and the unfixed image is heated and fixed.

Figure 3:
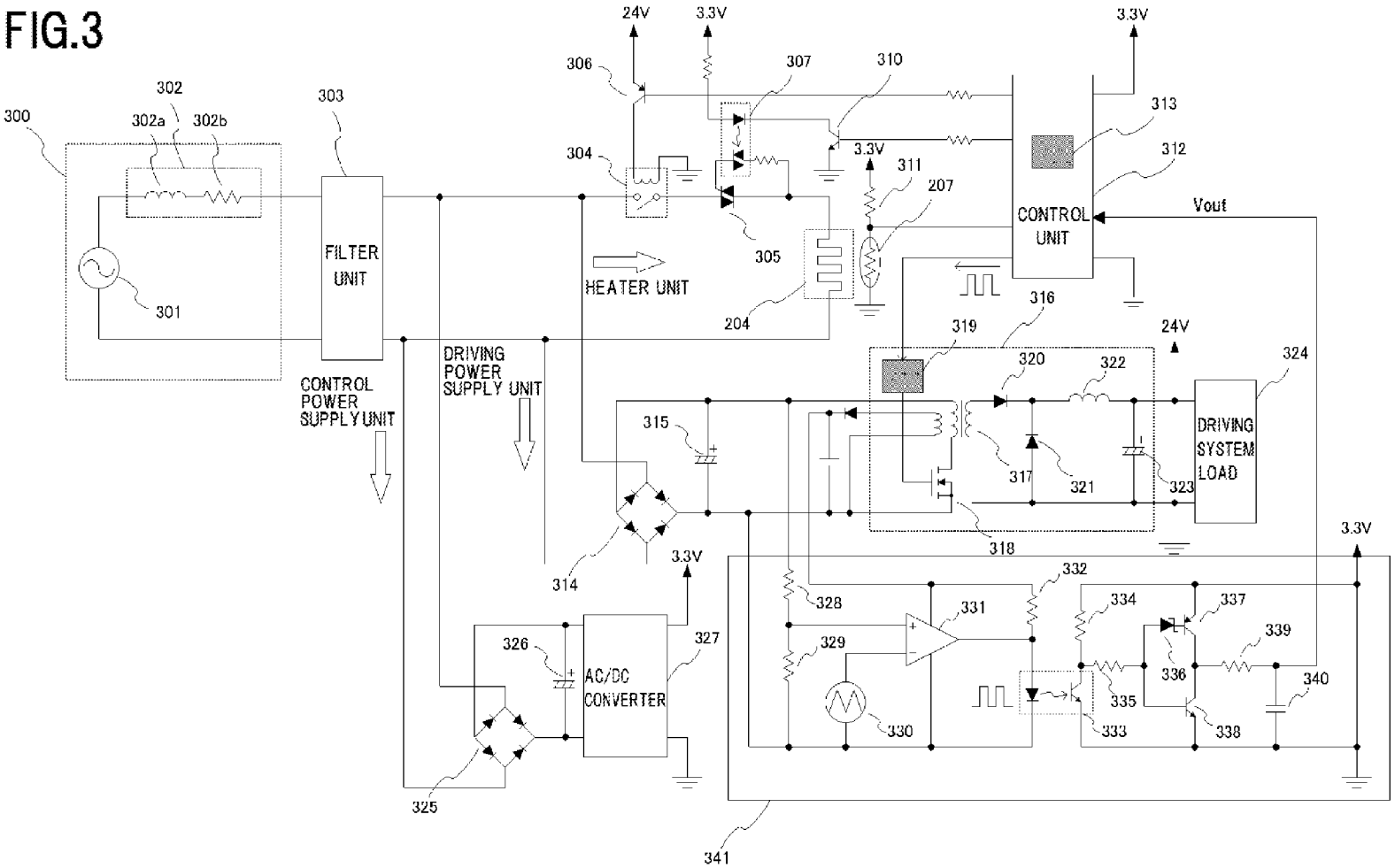
FIG. 3 is a diagram illustrating a portion of an electronic circuit of an image forming apparatus according to a first embodiment.

FIG. 3 is a circuit diagram (power supply circuit diagram) illustrating a portion of an electronic circuit for driving and controlling the image forming apparatus 100 according to the first embodiment. An AC power supply (commercial AC power supply) 300 includes an output-side open-circuit voltage 301 of a transformer on the electric pole and an output impedance 302. The output impedance 302 mainly includes an inductive component 302*a* and a resistive component 302*b*. The AC voltage supplied from the AC power supply 300 is distributed to three units of a heater unit, a driving power supply unit, and a control power supply unit after passing through a filter unit 303.

The heater 204 is connected to the AC power supply 300 via a relay 304 and a triac 305. The relay 304 that operates with a 24V-power supply operates when a driving signal is sent from a control unit 312 to a transistor 306. The triac 305 is driven by a driving circuit having a phototriac 307 and a transistor 310. This driving circuit operates with a 3.3V-power supply. When a driving signal is sent from the control unit 312 to the transistor 310, a current is supplied from the 3.3V-power supply to a diode portion of the phototriac 307. As a result, a thyristor portion of the phototriac 307 becomes conductive and a current flows into the gate of the triac 305 so that the triac 305 operates. The thermistor 207 is pressed against the rear surface of the heater 204 with a predetermined pressure. The thermistor 207 is an element whose resistance value changes with the temperature. A voltage obtained by dividing 3.3 V by a resistance value of the thermistor 207 and a pull-up resistor 311 is input to the control unit 312, and the temperature of the heater 204 is detected based on the voltage. The control unit 312 turns the triac 305 on and off based on the temperature information detected by the thermistor 207 to thereby control the power supplied to the heater 204.

In the driving power supply unit, the AC voltage of the AC power supply 300 is rectified by a rectifier diode 314 and is smoothed by a primary smoothing capacitor 315. The smoothed voltage is converted into a DC voltage of 24 V by a driving AC/DC converter 316. The AC/DC converter 316 includes a transformer 317, a FET 318, a FET control unit 319, a rectifier diode 320, a current diode 321, a choke coil 322, a secondary smoothing capacitor 323. The generated DC voltage 24 V is used for a driving system load 324 such as a motor, a solenoid, or a fan (not illustrated). On the other hand, in the control power supply unit, the AC voltage of the AC power supply 300 is rectified by a rectifier diode 325 and is smoothed by a primary smoothing capacitor 326. The smoothed voltage is converted into a DC voltage of 3.3 V by a control AC/DC converter 327. The generated DC voltage 3.3 V is used for the control unit 312, the Vc detecting unit 341, and the like.

Figure 4:
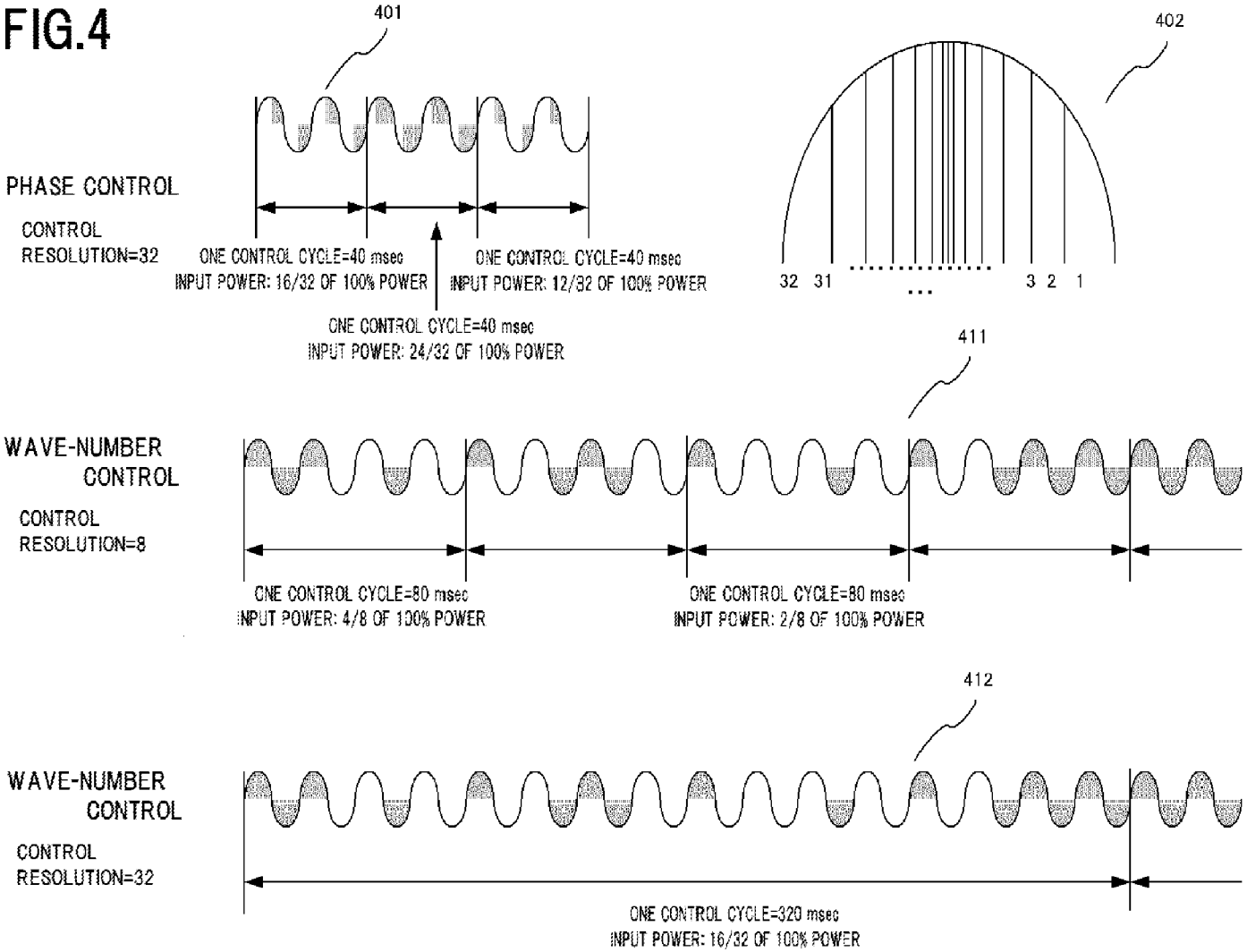
FIG. 4 is a diagram for illustrating a method of controlling power supplied to a heater.
Figure 5:
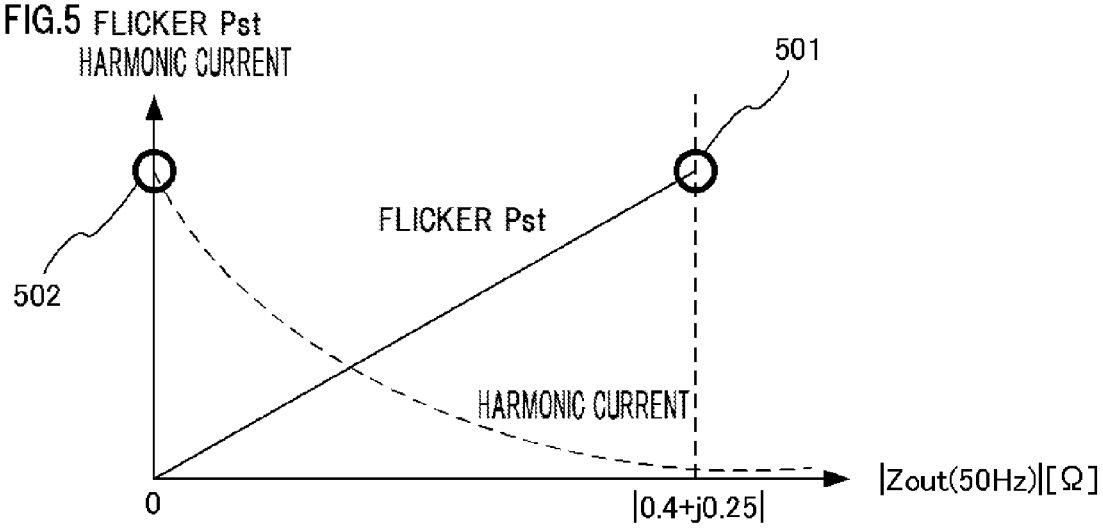
FIG. 5 is a diagram illustrating a relation among an output impedance, a flicker Pst, and a harmonic current.

FIG. 4 is a schematic diagram for illustrating a method of controlling the power supplied to the heater 204. In phase control, as indicated by 401 in FIG. 4, the triac 305 is turned on at a predetermined phase angle every half-wave of the AC voltage of the AC power supply 300 to thereby control the supply of power to the heater 204. In the waveform patterns of FIG. 4, hatched portions indicate periods in which power is input and non-hatched portions indicate periods in which power is not input. The ON time-points corresponding to respective phase angles when one half-wave of the AC voltage of the AC power supply 300 is divided into a plurality of numbers (thirty-two pieces in this example) as indicated by reference numeral 402 in FIG. 4 are prepared in a memory (storage unit) 313 included in the control unit 312 as a table. The thirty-two phase angles are set in a proportional relation with the power. In wave-number control, the power supplied to the heater 204 is controlled based on the number of half-waves corresponding to an energization period within one control cycle (eight half-waves in this example) using a half-wave as a minimum unit as indicated by reference numeral 411 in FIG. 4. The half-wave pattern corresponding to an energization period is prepared in the memory 313 as a table. Phase control is suitable for realizing the control of increasing the power resolution to decrease the power fluctuation. Since the phase control can increase the power resolution by increasing the number of divisions of a half-wave, it is possible to increase the power resolution without changing one control cycle. On the other hand, in the case of wave-number control, it is necessary to increase the number (thirty-two half-waves in this example) of half-waves in one control cycle as indicated by reference numeral 412 in FIG. 4 in order to increase the power resolution. That is, there is a problem in that the length of one control cycle increases and the control response time increases.

Figure 6:
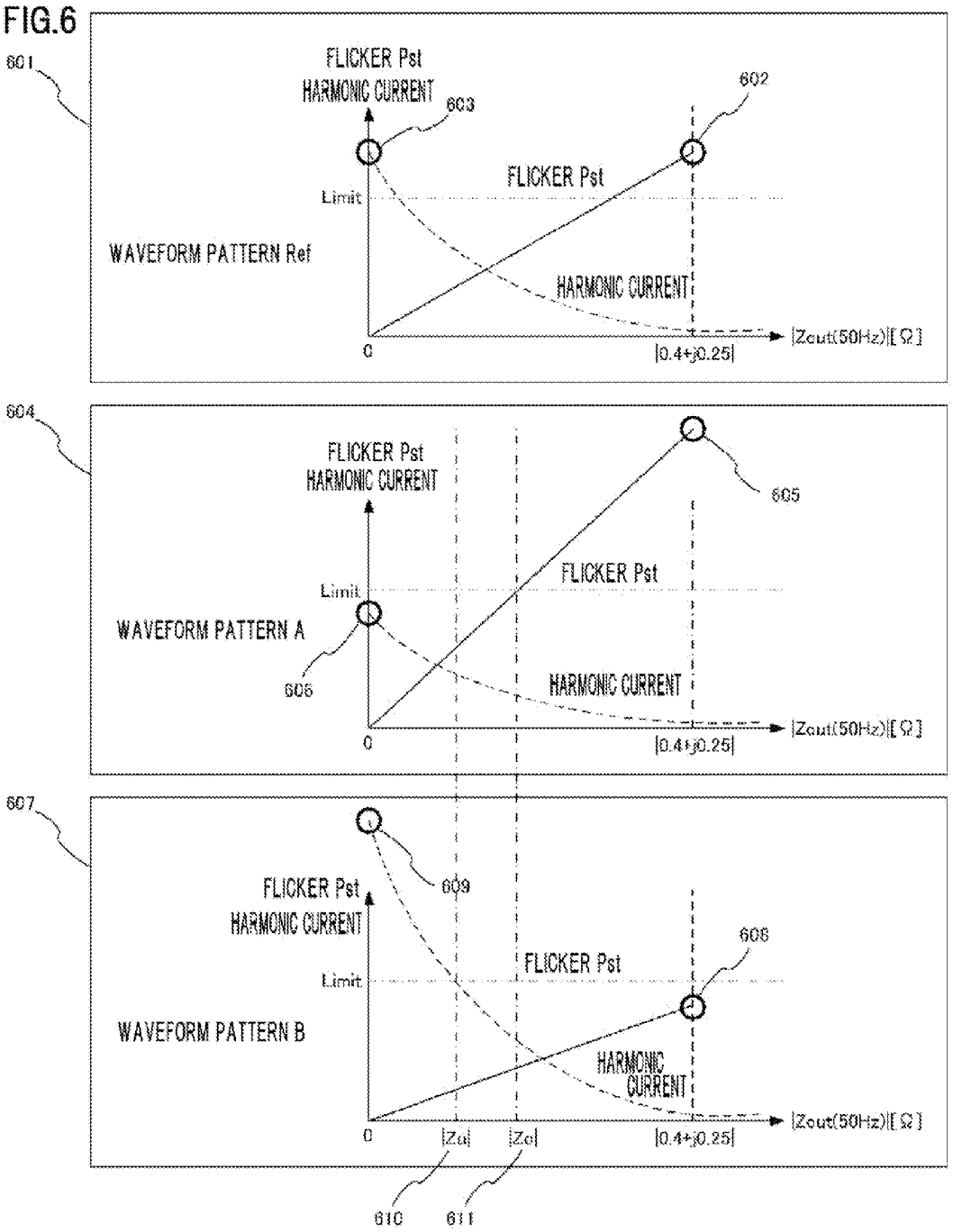
FIG. 6 is a diagram illustrating a relation among an output impedance, a flicker Pst, and a harmonic current.

Here, the flicker and harmonic current standards will be described with reference to FIG. 6. FIG. 6 is a diagram illustrating a relation among the output impedance, the flicker Pst, and the harmonic current of each waveform pattern illustrated in FIG. 8. The waveforms illustrated in FIG. 8 have one control cycle of eight half-waves. As described above, the flicker and the harmonic current are in a trade-off relation with respect to the output impedance 302. A graph indicated by reference numeral 601 in FIG. 6 illustrates a relation among the flicker, the harmonic current, and the output impedance Zout 302 when a waveform pattern Ref (a waveform in a table REF) is used as a waveform of a current supplied to the heater 204. The horizontal axis represents the absolute value |Zout (50 Hz)| of the output impedance at the frequency 50 Hz of the AC power supply 300 and the vertical axis represents the a flicker Pst and the harmonic current. In the graph, the solid line indicates the flicker Pst, the broken line indicates the harmonic current, and Limit indicates a standard value defined by IEC, of each of the flicker Pst and the harmonic current. According to the graph 601 in FIG. 6, it can be understood that the harmonic current and the flicker Pst exceed the standard values when |Zout (50 Hz)| is near 0 and |0.4+j0.25|Ω, respectively (see 603 and 602 in FIG. 6). That is, when the waveform pattern Ref is used as the waveform of the current supplied to the heater 204, the flicker and the harmonic current do not satisfy the standards.

As described above, the flicker and the harmonic current are in a trade-off relation. Thus, two waveform patterns A and B (first and second waveform patterns, respectively) are considered as patterns in which the flicker or the harmonic current is particularly suppressed in the waveform pattern Ref. The waveform pattern A is a waveform set in a table A in FIG. 8 and the waveform pattern B is a waveform set in a table B in FIG. 8. Naturally, each sum of the amounts of power in one control cycle in each of these patterns is equal to that in each of the patterns of the waveform pattern Ref. That is, the waveform patterns of the respective tables have the same amount of power as long as the power levels are equal but have different shapes of waveforms. A graph indicated by reference numeral 604 in FIG. 6 illustrates a relation among the flicker, the harmonic current, and |Zout (50 Hz)| when the waveform pattern A, which is kind of disadvantageous in suppressing flicker but is advantageous in suppressing harmonic currents, is used. According to the graph 604, it can be understood that, although the flicker Pst worsens, the harmonic current is suppressed to be lower than the standard value when |Zout (50 Hz)|=0 (see 606 in FIG. 6). A graph indicated by reference numeral 607 in FIG. 6 illustrates a relation among the flicker, the harmonic current, and |Zout (50 Hz)| when the waveform pattern B, which is kind of disadvantageous in suppressing harmonic currents but is advantageous in suppressing flicker is used. According to the graph 607, it can be understood that, although the harmonic current worsens, the flicker Pst is suppressed to be lower than the standard value when |Zout (50 Hz)|=|0.4+j0.25|Ω (see 608 in FIG. 6).

From the above, it can be understood that only the waveform pattern A can satisfy the standards in a range of 0<|Zout (50 Hz)|<|Zu| (see 610 in FIG. 6). Moreover, both the waveform patterns A and B can satisfy the standards in a range of |Zu|<|Zout (50 Hz)|<|Zo| (see reference numeral 611 in FIG. 6). Further, only the waveform pattern B can satisfy the standards in a range of |Zo|<|Zout (50 Hz)|<|0.4+j0.25|Ω. In this embodiment, control of changing the waveform pattern (that is, the waveform table) according to the value of |Zout (50 Hz)| is performed. That is, using |Zth| that satisfies a relation of |Zu|<|Zth|<|Zo| as a threshold (reference value), the waveform pattern A (first waveform table) is used when |Zout (50 Hz)|<|Zth| and the waveform pattern B (second waveform table) is used when |Zout (50 Hz)|>|Zth|. By doing so, the flicker and harmonic current standards can be satisfied when the output impedance 302 is between 0 and 0.4+j0.25Ω.

A method of calculating |Zout (50 Hz)| (=Rout) will be described. Here, a circuit configuration associated with calculation of |Zout (50 Hz)| corresponds to an output impedance calculating unit (acquiring unit). Moreover, a circuit configuration associated with detection of a voltage value accumulated in the primary smoothing capacitor 315 corresponds to a voltage detecting unit. The voltage accumulated in the primary smoothing capacitor 315 of the driving power supply unit when the heater 204 is not energized is defined as Vcoff, and the voltage accumulated in the primary smoothing capacitor 315 when the heater 204 is fully energized is defined as Vcon. |Zout (50 Hz)| can be expressed using the voltage Vcoff, the voltage Vcon, and the resistance value Rheater of the heater 204. Here, the expression "the heater 204 is fully energized" means that the triac 305 is constantly turned on at a phase angle of 0° (that is, the heater 204 is energized with the level 14 illustrated in FIG. 8). Moreover, the resistance value Rheater is a design value and is a fixed value.

When the triac 305 is off, since no current flows into the heater 204, the current supplied from the AC power supply 300 is only the sum Ipwr of the currents flowing into the driving power supply unit and the control power supply unit. Thus, the voltage Vcoff accumulated in the primary smoothing capacitor 315 when the triac 305 is off is expressed by Equation 1. Here, Vin is the voltage of the AC power supply 300 when the image forming apparatus 100 has no load.

$$V_{coff}=(V_{in}-I_{pwr}\times|Z_{out}(50\text{ Hz})|) \quad \text{[Equation 1]}$$

On the other hand, the current supplied from the AC power supply 300 when the triac 305 is on is an addition of Ipwr and the current Iheater flowing into the heater 204. Thus, the voltage Vcon accumulated in the primary smoothing capacitor 315 when the triac 305 is on is expressed by Equation 2.

$$V_{con}=(V_{in}-(I_{pwr}+I_{heater})\times|z_{out}(50\text{ Hz})|) \quad \text{[Equation 2]}$$

From Equations 1 and 2, |Zout (50 Hz)| is expressed by Equation 3.

$$|Z_{out}(50\text{ Hz})|=\frac{V_{coff}-V_{con}}{I_{heater}}=\left(\frac{V_{coff}}{V_{con}}-1\right)\times R_{heater} \quad \text{[Equation 3]}$$

Figure 11:
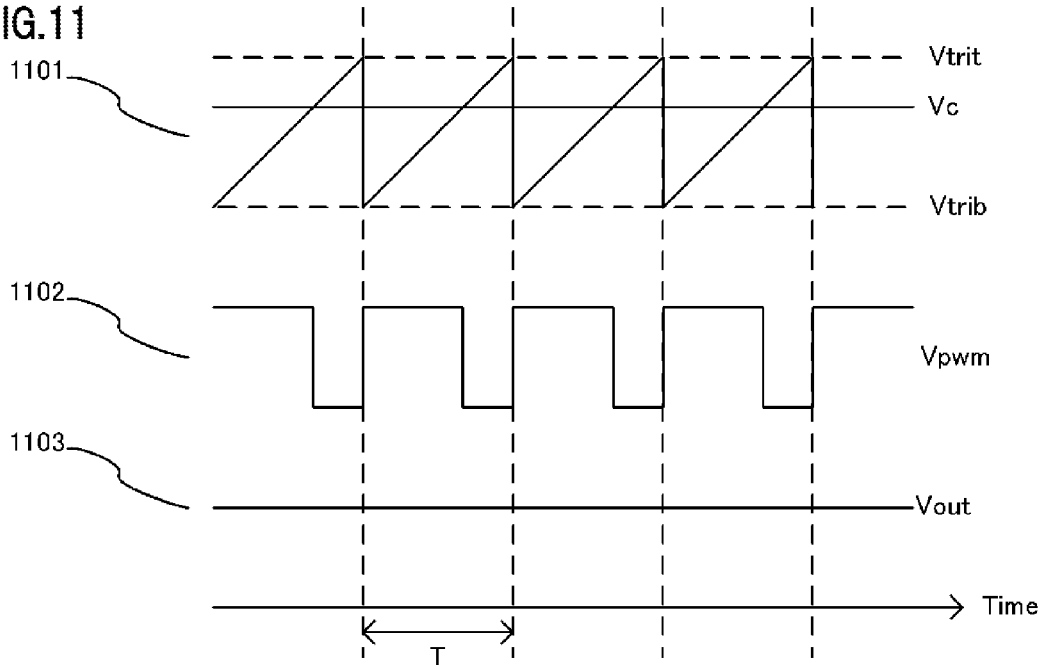
FIG. 11 is a diagram illustrating circuit operation waveforms of a Vc detecting unit.

FIG. 11 is a diagram illustrating a circuit operation waveform of the Vc detecting unit. A method of calculating the voltage Vc (Vcoff when the heater 204 is not energized or Vcon when the heater 204 is fully energized) accumulated in the primary smoothing capacitor 315 of the driving power supply unit will be described with reference to FIG. 11 and the Vc detecting unit 341 of FIG. 3.

The voltage Vc accumulated in the primary smoothing capacitor 315 of the driving power supply unit is divided by resistors 328 and 329 and input to a positive terminal of a comparator 331. A voltage generated by a triangular wave generator 330, whose highest voltage is Vtrit and lowest voltage is Vtrib, is input to a negative terminal of the comparator 331. A graph indicated by reference numeral 1101 in FIG. 11 illustrates the relation among Vc, the triangular wave, the highest voltage Vtrit, and the lowest voltage Vtrib. An auxiliary coil is wound around a primary side of the transformer 317 of the driving power supply unit, and an output terminal of the comparator 331 is pulled up by a resistor 332 in relation to the voltage generated by the auxiliary coil. Due to this, a PWM waveform Vpwm having a duty corresponding to Vc is output to the output terminal of the comparator 331. A graph indicated by reference numeral 1102 in FIG. 11 illustrates the Vpwm waveform. Vpwm is Hi when the triangular wave is Vc or lower, whereas Vpwm is Lo when the triangular wave is Vc or higher. The duty [%] of Vpwm is expressed by Equation 4.

$$\text{Duty} = \frac{V_c - V_{trit}}{V_{trit} - V_{trib}} \times 100 \quad \text{[Equation 4]}$$

This PWM signal is transmitted to the secondary side of the transformer 317 via a photo-coupler 333. The PWM signal transmitted to the secondary side is filtered by resistors 334 and 335, a zener diode 336, a PNP transistor 337, an NPN transistor 338, a resistor 339, and a capacitor 340. In this way, an analog voltage value Vout that is proportional to the duty of the PWM signal is generated. A graph indicated by reference numeral 1103 in FIG. 11 illustrates the Vout waveform. Vout is expressed by Equation 5 using the duty.

$$V_{out} = \frac{\text{Duty}}{100} \times 3.3 \quad \text{[Equation 5]}$$

From Equations 4 and 5, Vout is expressed by Equation 6 as a function of Vc.

$$V_{out} = \frac{V_c - V_{trit}}{V_{trit} - V_{trib}} \times 3.3 \quad \text{[Equation 6]}$$

Vtrit and Vtrib in Equation 6 are determined so that a dynamic range of Vout can be secured to be as large as possible by taking a detection range of Vc (that is, the width of Vcon in the heater ON-state and Vcoff in the heater OFF-state) into consideration. In this embodiment, the detection range of Vc is set in the following manner.

First, the voltage range of the AC power supply 300 when the output impedance 302 is 0Ω is set in the range of −15% to +10% (that is, 85 V to 140 V) of the rated voltage of 100 V to 127 V. The range of the output impedance 302 is set in the range of 0 to twice the output impedance (=|0.4+j0.25(50 Hz)|Ω=0.47Ω(50 Hz)) designated during measurement of flicker (that is, in the range of 0 to 1Ω). Moreover, the resistance value Rheater of the heater 204 is set to 10Ω. In this case, when the heater 204 is fully energized at the output impedance 302 of 1Ω, the voltage of the AC power supply 300 decreases from 85 V up to 77 V. Thus, the voltage range of the AC power supply 300 is set in the range of 77 V to 140 V.

Since Vc, which is a voltage obtained by rectifying and smoothing the voltage of the AC power supply 300, is approximately identical to a multiplication of the voltage of the AC power supply 300 by √2, the voltage range of Vc is between 108 V and 198 V when the voltage range of the AC power supply 300 is between 77 V and 140 V. Thus, Vtrit=198 V and Vtrib=108 V. That is, Equation 6 is expressed as Equation 7.

$$V_{out} = \frac{V_c - 108}{198 - 108} \times 3.3 \quad \text{[Equation 7]}$$

If Voutoff is Vout when Vc=Vcoff and Vouton is Vout when Vc=Vcon, the absolute value |Zout (50 Hz)| of the output impedance is expressed as Equation 8 from Equations 3 and 7.

$$|Z_{out}(50\text{ Hz})| = \frac{V_{outoff} - V_{outon}}{V_{outon} + 3.96} \times R_{heater} \quad \text{[Equation 8]}$$

Here, fluctuation of |Zout (50 Hz)| due to fluctuation of Rheater will be described. From Equation 8, |Zout (50 Hz)| is proportional to Rheater. The heater 204 is formed by pasting a heat generating member on a ceramic substrate, and fluctuation in the resistance value Rheater during manufacturing is inevitable. A fluctuation in Rheater is generally approximately ±5%. The threshold (reference value) |Zth| needs to be set by taking the fluctuation in Rheater into consideration. For example, when the Rheater has an upper-limit value, |Zout (50 Hz)| is calculated to be smaller than the actual value. If the difference exceeds |Zo|−|Zth|, the flicker may exceed the standard value (thus, the waveform pattern A is used since the calculated |Zout (50 Hz)| is equal to or smaller than |Zth| although the actual |Zout (50 Hz)| exceeds |Zo|). Conversely, when the Rheater has a lower-limit value, |Zout (50 Hz)| is calculated to be larger than the actual value. If the difference exceeds |Zth|−|Zu|, the harmonic current may exceed the standard value (thus, the waveform pattern B is used since the calculated |Zout (50 Hz) | is equal to or larger than 1Zth 1 although the actual |Zout (50 Hz)| is smaller than |Zu|).

Figure 12:
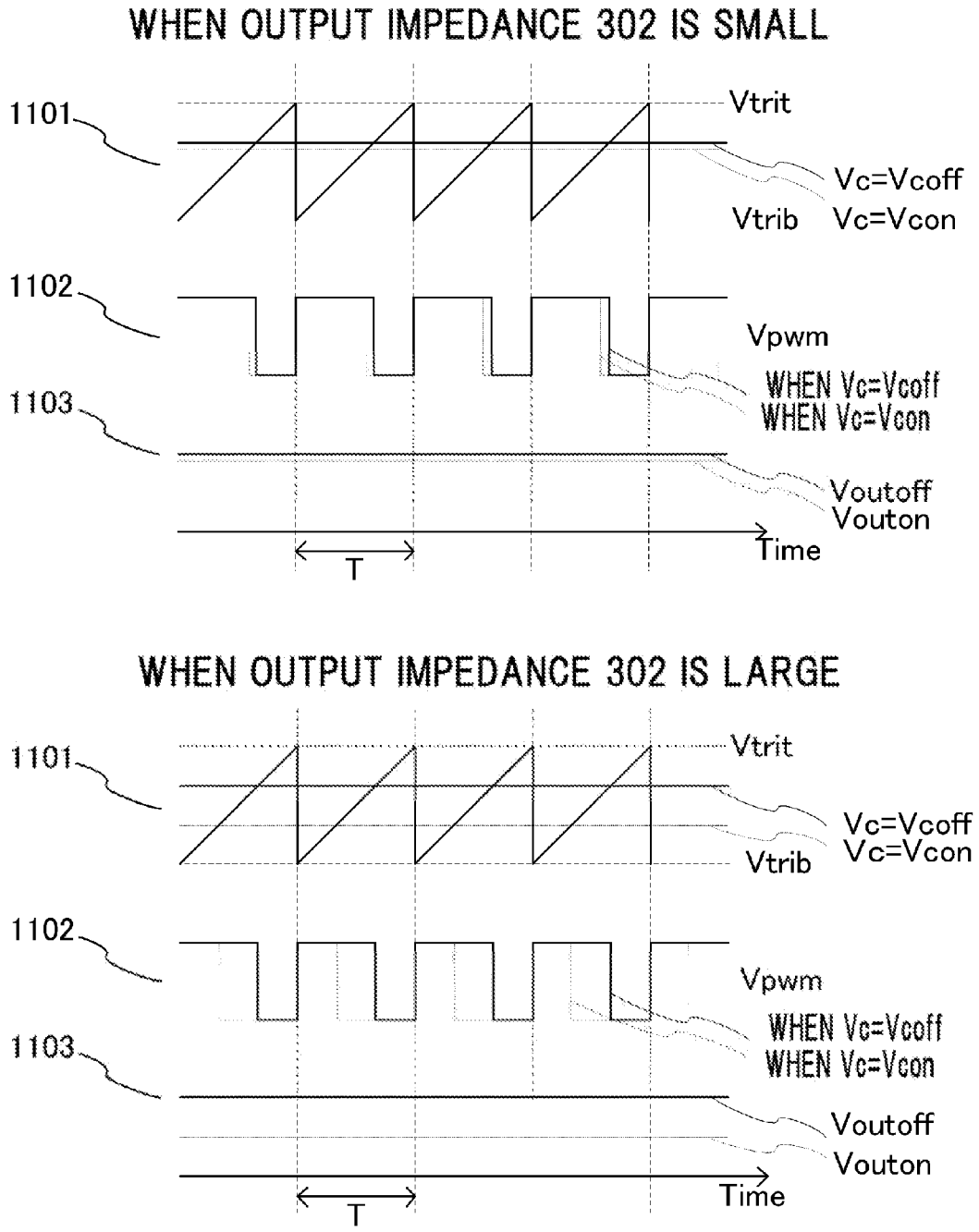
FIG. 12 is a diagram illustrating a difference between Voutoff and Vouton when the output impedance is small and when the output impedance is large.

From the above, if a fluctuation in Rheater is ±β [%], |Zth| needs to be determined so that (|Zo|−|Zth|)/|Zth|>β/100 and (|Zth|−|Zu|)/|Zth|>β/100. FIG. 12 illustrates the difference between Voutoff and Vouton when the output impedance is small and the difference between Voutoff and Vouton when the output impedance is large. The difference between Voutoff and Vouton is small when the output impedance is small, whereas the difference between Voutoff and Vouton is large when the output impedance is large.

Figure 7:
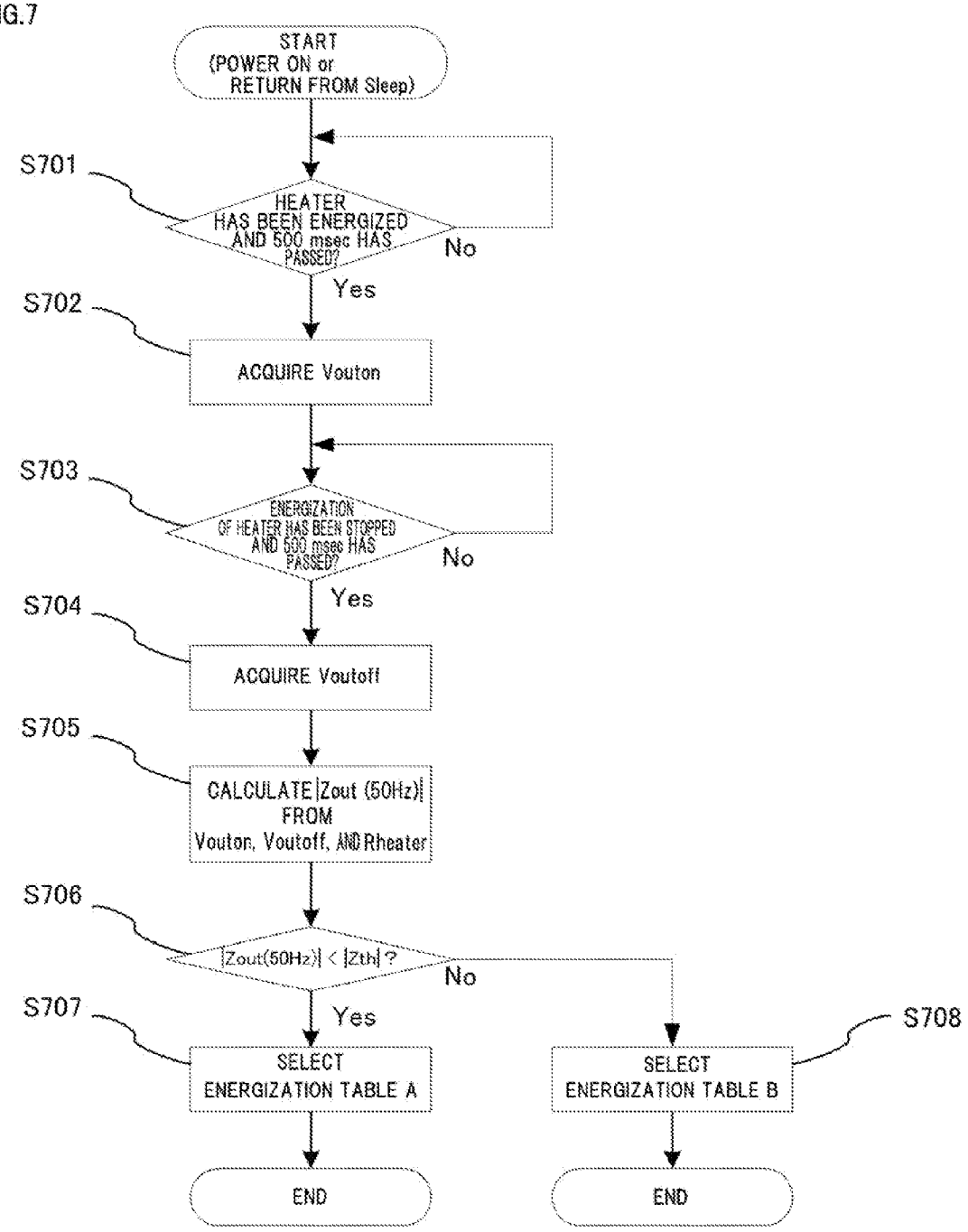
FIG. 7 is a diagram for illustrating the flow of selecting an energization table according to the first embodiment.

FIG. 7 is a diagram for illustrating the flow of selecting an energization table (waveform table) according to the first embodiment. First, when the power of the image forming apparatus 100 is turned on or the image forming apparatus 100 returns from a sleep state, an initialization operation starts. After that, when the time-point at which the heater 204 is fully energized occurs and this state continues for 500 msec (S701), the control unit 312 acquires Vouton (S702). When the time-point occurs at which the energization of the heater 204 ends, and this state continues for 500 msec (S703), the control unit 312 acquires Voutoff (S704). Here, full-energization of the heater 204 and ending the energization of the heater 204 are part of the initialization operation and are not newly added sequences. However, when the period in which the heater 204 is fully energized does not continue for 500 msec, a dedicated sequence may be added. Full-energization is performed to increase the detection accuracy of Vouton, and full-energization may not be performed in some cases. Moreover, 500 msec is a period sufficiently longer than a period in which Vc is stabilized when the voltage of the AC power supply 300 fluctuates due to the output impedance 302.

Subsequently, |Zout (50 Hz)| is calculated using Equation 8 based on the acquired Vouton and Voutoff and the resistance value Rheater of the heater 204 (S705) and is compared with the threshold (reference value) |Zth| (S706). The energization table A is selected if |Zout (50 Hz)| is smaller than |Zth| (S707), and the energization table B is selected if |Zout (50 Hz)| is equal to or larger than |Zth| (S708). In the selected table, the amount of power (power level) to be supplied to the heater 204 is selected based on temperature information and power is supplied to the heater 204 according to a waveform pattern corresponding to the selected level.

FIG. 8 is a diagram illustrating an energization table (waveform table) showing examples of waveform patterns at respective power levels. Here, the energization table Ref is a table including a plurality of waveform patterns Ref. Moreover, the energization table A (first waveform table) is a table including a plurality of waveform patterns A similar to that of wave-number control, which is advantageous in suppressing harmonic currents. That is, the plurality of waveform patterns A includes a large number of patterns in which the proportion of energization based on wave-number control is relatively larger than the proportion of energization based on phase control within one control cycle in control pattern (hybrid control) in which wave-number control and phase control are combined. On the other hand, the energization table B (second waveform table) is a table including a plurality of waveform patterns B similar to that of phase control, which is advantageous in suppressing flicker. That is, the plurality of waveform patterns B includes a large number of patterns in which the proportion of energization based on phase control is relatively larger than the proportion of energization based on wave-number control in one control cycle in hybrid control. In the waveform patterns of FIG. 8, hatched portions indicate periods in which power is input and non-hatched portions indicate periods in which power is not input. In the respective waveform patterns, the power resolution is 15 and the power levels are ranked LEVEL0, 1, . . . , and 14 in descending order of power. In the energization tables A and B, the phase angle of each half-wave in one control cycle changes slightly. For example, since LEVEL7 corresponds to a power level at which 50% of power is supplied, the duty ratio of each half-wave should be 50% (the phase angle is 90°) in the case of the energization table B. However, actually, 55% and 45% of power each are used in four half-waves. This is to prevent harmonic currents from occurring only in a certain order. The waveform patterns illustrated in FIG. 8 are examples only and the present invention is not limited thereto.

From the above, the image forming apparatus according to this embodiment supplies power to the heater 204 by selecting the waveform pattern A that is advantageous in suppressing harmonic currents when the output impedance 302 of the AC power supply 300 is smaller than the reference value and selecting the waveform pattern B that is advantageous in suppressing flicker when the output impedance 302 is equal to or larger than the reference value. By changing the waveform pattern of a current supplied to the heater 204 according to the value of the output impedance 302 of the AC power supply 300 as in this embodiment, it is possible to suppress an increase in the cost and the space as much as possible and to realize a configuration that satisfies the flicker and harmonic current standards.

(Second Embodiment)

Figure 9:
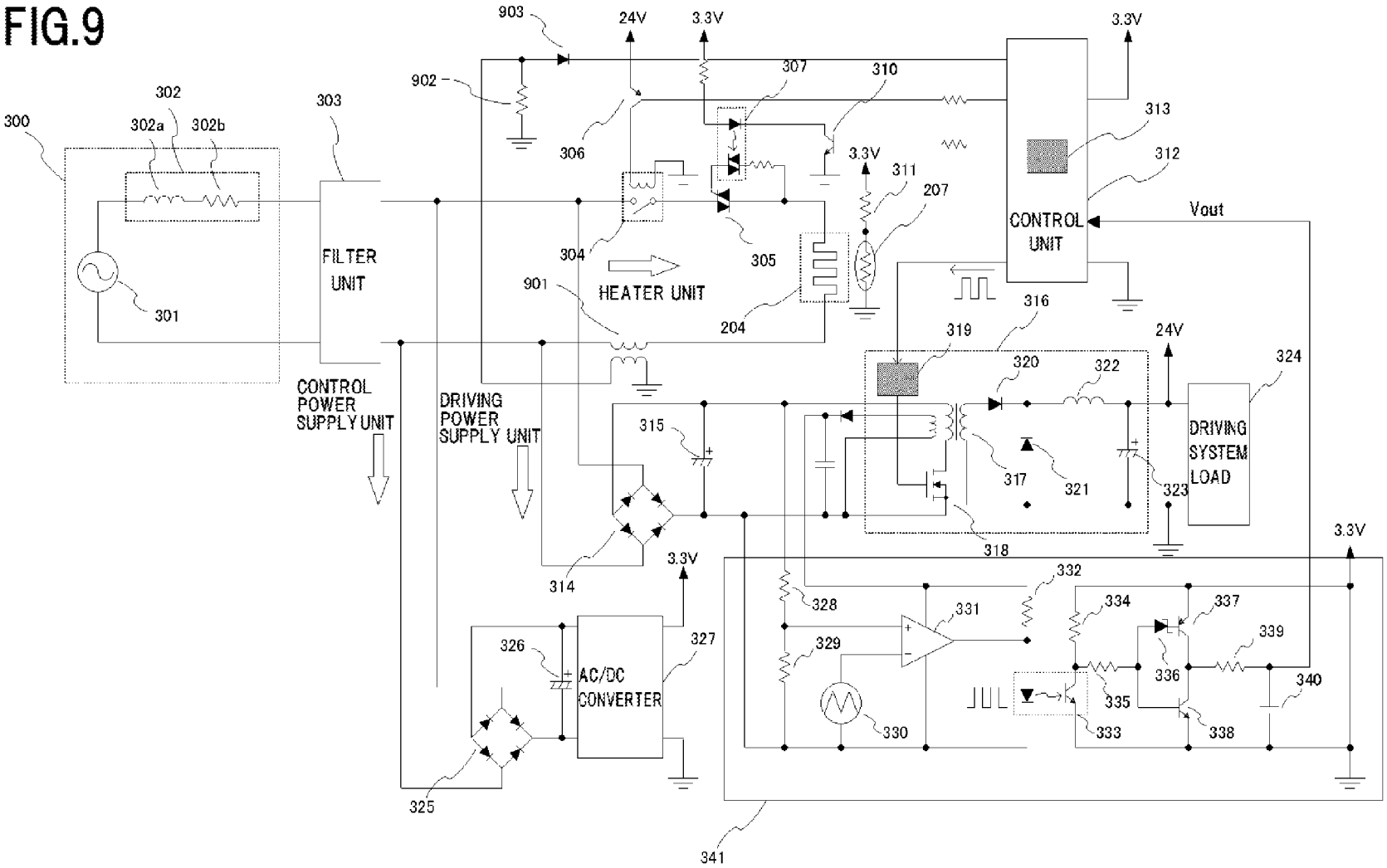
FIG. 9 is a diagram illustrating a portion of an electronic circuit of an image forming apparatus according to a second embodiment.

An image forming apparatus according to a second embodiment of the present invention will be described with reference to FIGS. 9 and 10. A redundant description of the portions of this embodiment overlapping those of the first embodiment will not be provided. FIG. 9 is a circuit diagram (power supply circuit diagram) illustrating a portion of an electronic circuit for driving and controlling the image forming apparatus 100 according to the second embodiment. The difference from the first embodiment is that a current flows into the heater 204 via a current transformer 901. The current flowing through the current transformer 901 is converted into a voltage by a resistor 902 and the voltage is transmitted to the control unit 312. Since current detection is performed in only a half-wave, a diode 903 is connected. Here, in this power supply circuit, a circuit configuration associated with detection of an effective current value flowing into the heater 204 corresponds to a current detecting unit.

If the current Iheater flowing into the heater 204 can be detected, |Zout (50 Hz)| is expressed as Equation 9 from Equations 3 and 7.

$$|Z_{out}(50\ \text{Hz})| = (V_{outoff} - V_{outon}) \times \frac{27}{I_{heater}} \qquad \text{[Equation 9]}$$

In the first embodiment, since Rheater is a fixed value, it is necessary to take a fluctuation in Rheater and a fluctuation in |Zout (50 Hz)| into consideration. However, in the second embodiment, since Iheater is detected, it is not necessary to take a fluctuation in Rheater into consideration, and thus, highly accurate |Zout (50 Hz)| can be calculated.

Figure 10:
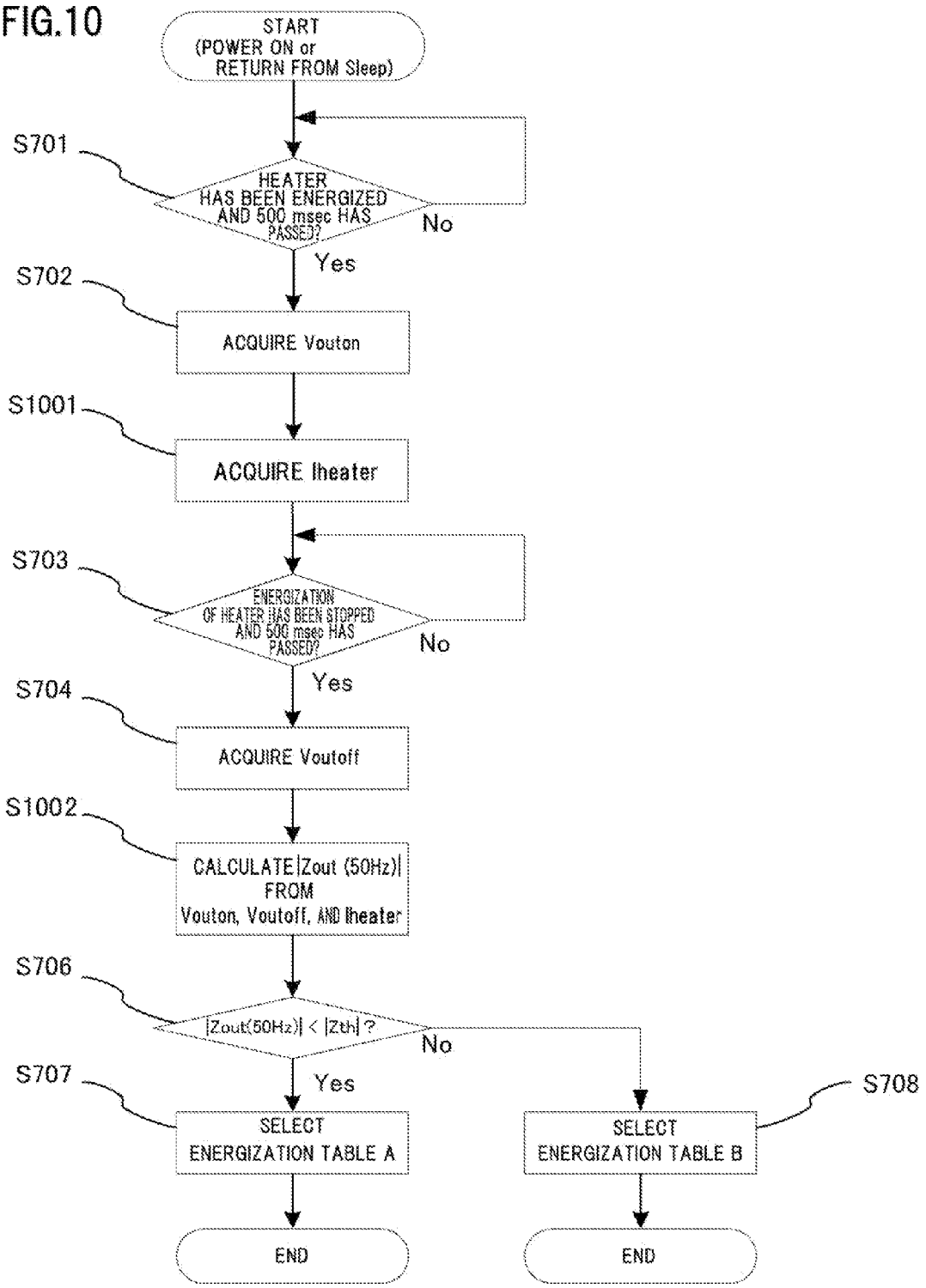
FIG. 10 is a diagram for illustrating the flow of selecting an energization table according to the second embodiment.

FIG. 10 is a diagram for illustrating the steps for selecting an energization table according to the second embodiment. In this section, only the difference from the first embodiment will be described. The control unit 312 acquires Vouton and acquires the current Iheater flowing into the heater 204 (S1001). Moreover, |Zout (50 Hz)| is calculated based on the acquired Vouton and Voutoff and the Iheater (S1002). The energization table A or B is selected based on the calculated |Zout (50 Hz)|.

From the above, by detecting the current value flowing into the heater 204 as in this embodiment, it is possible to calculate the output impedance 302 of the AC power supply 300 with high accuracy.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-102660, filed May 16, 2014, which is hereby incorporated by reference herein in its entirety.

What is claimed is:

1. An image forming apparatus comprising:

an image forming unit that forms an unfixed toner image on a recording material;

a fixing unit that heats the unfixed toner image formed on the recording material and fixes the unfixed toner image to the recording material, the fixing unit having a heat generating member that generates heat with power supplied from a commercial AC power supply;

a control unit that controls the supply of the power to the heat generating member from the commercial AC power supply according to the temperature of the fixing unit, the control unit performing control so that an alternating-current waveform corresponding to the supplied power flows into the heat generating member;

a power supply unit that generates a DC voltage from an AC voltage;

a voltage detecting unit that detects a voltage accumulated in a primary smoothing capacitor provided in the power supply unit, and an acquiring unit that acquires an output impedance of the commercial AC power supply, the acquiring unit acquires the output impedance based on the difference between the output voltage of the voltage detecting unit when no power is supplied to the heat generating member and the output voltage of the voltage detecting unit when power is supplied to the heat generating member, wherein the control unit uses a predetermined number of successive half-waves of an alternating current as one control cycle, sets the supplied power corresponding to the temperature of the fixing unit every one control cycle, and performs control so that an alternating-current waveform including both a phase control waveform and a wave-number control waveform flows into the heat generating member during one control cycle, the control unit is configured to select a first waveform table in which the alternating-current waveforms corresponding to the supplied powers are set and a second waveform table in which alternating-current waveforms different from the alternating-current waveforms set in the first waveform table are set, the alternating-current waveforms set in the second waveform table are alternating-current waveforms in which the proportion of phase control waveforms in one control cycle is larger than that in the first waveform table, the control unit selects the first waveform table or the second waveform table according to the output impedance acquired by the acquiring unit, and the control unit selects the first waveform table when the output impedance is smaller than a reference value and selects the second waveform table when the output impedance is larger than the reference value.

2. The image forming apparatus according to claim 1, wherein the output impedance is calculated by an equation below:

$$R_{out} = \left(\frac{V_{coff}}{V_{con}} - 1\right) \times R_{heater}$$

where

Rout: the output impedance [Ω],

Vcoff: a voltage value [V] detected by the voltage detecting unit when no power is supplied to the heat generating member, Vcon: a voltage value [V] detected by the voltage detecting unit when power is supplied to the heat generating member, and Rheater: a resistance value [Ω] of the heat generating member.

3. The image forming apparatus according to claim 1, further comprising:

a current detecting unit that detects a current flowing into the heat generating member, wherein the output impedance is calculated by an equation below:

$$R_{out} = \frac{V_{coff} - V_{con}}{I_{heater}}$$

where

Rout: the output impedance [Ω],

Vcoff: a voltage value [V] detected by the voltage detecting unit when no power is supplied to the heat generating member, Vcon: a voltage value [V] detected by the voltage detecting unit when power is supplied to the heat generating member, and Iheater: a current value [A] detected by the current detecting unit.

4. The image forming apparatus according to claim 1, wherein the fixing unit has a cylindrical fixing film rotating in contact with the recording material, and the heat generating member is in contact with an inner surface of the fixing film.

5. An image forming apparatus comprising:

an image forming unit that forms an unfixed toner image on a recording material;

a fixing unit that heats the unfixed toner image formed on the recording material and fixes the unfixed toner image to the recording material, the fixing unit having a heat generating member that generates heat with power supplied from a commercial AC power supply;

a control unit that controls the supply of the power to the heat generating member from the commercial AC power supply according to the temperature of the fixing unit, the control unit using a predetermined number of successive half-waves of an alternating current as one control cycle, setting the supplied power corresponding to the temperature of the fixing unit every one control cycle, and performing control so that an alternating-current waveform including both a phase control waveform and a wave-number control waveform flows into the heat generating member during one control cycle; and an acquiring unit that acquires an output impedance of the commercial AC power supply, wherein the control unit is configured to select a first waveform table in which the alternating-current waveforms corresponding to the supplied powers are set and a second waveform table in which an alternating-current waveforms different from the alternating-current waveforms set in the first waveform table are set, the control unit selects the first waveform table or the second waveform table according to the output impedance acquired by the acquiring unit, the alternating-current waveforms set in the second waveform table are alternating-current waveforms in which the proportion of phase control waveforms in one control cycle is larger than that in the first waveform table, and the control unit selects the first waveform table when the output impedance is smaller than a reference value and selects the second waveform table when the output impedance is larger than the reference value.

6. The image forming apparatus according to claim 5, wherein the fixing unit has a cylindrical fixing film rotating in contact with the recording material, and the heat generating member is in contact with an inner surface of the fixing film.

* * * * *